US006397824B1

(12) United States Patent
Takatsuka et al.

(10) Patent No.: US 6,397,824 B1
(45) Date of Patent: Jun. 4, 2002

(54) FAULT DIAGNOSING APPARATUS FOR EVAPOPURGE SYSTEMS

(75) Inventors: Takashi Takatsuka; Hidetsugu Kanao; Tomonobu Sakagami; Kenji Saito; Tateo Kume; Haruki Fukuda, all of Aichi (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/633,345

(22) Filed: Aug. 4, 2000

(30) Foreign Application Priority Data

Aug. 6, 1999 (JP) ..... 11-223635

(51) Int. Cl.[7] ..... F02M 33/02
(52) U.S. Cl. ..... 123/520; 73/118.1
(58) Field of Search ..... 123/516, 518, 123/519, 520, 198 D, 698; 73/117.1, 117.2, 118.1, 118.2

(56) References Cited

U.S. PATENT DOCUMENTS

| | | | | | |
|---|---|---|---|---|---|
| 5,297,527 | A | * | 3/1994 | Suzuki et al. | 123/520 |
| 5,333,589 | A | * | 8/1994 | Otsuka | 123/520 |
| 5,398,661 | A | | 3/1995 | Denz et al. | 123/520 |
| 5,425,344 | A | | 6/1995 | Otsuka et al. | 123/520 |
| 5,575,265 | A | * | 11/1996 | Kurihara et al. | 123/520 |
| 5,614,665 | A | * | 3/1997 | Curran et al. | 73/118.1 |
| 5,699,775 | A | * | 12/1997 | Azuma | 123/520 |
| 5,750,888 | A | * | 5/1998 | Matsumoto et al. | 73/118.1 |
| 5,767,395 | A | * | 6/1998 | Goto et al. | 73/118.1 |
| 5,873,352 | A | * | 2/1999 | Kidokoro et al. | 123/520 |
| 6,016,690 | A | * | 1/2000 | Cook et al. | 73/49.2 |
| 6,016,792 | A | * | 1/2000 | Kawano et al. | 123/520 |
| 6,082,337 | A | * | 7/2000 | Fujimoto et al. | 123/520 |
| 6,131,448 | A | * | 10/2000 | Hyodo et al. | 73/118.1 |
| 6,164,123 | A | * | 12/2000 | Corkill | 73/49.7 |
| 6,220,229 | B1 | * | 4/2001 | Kawamura et al. | 123/520 |
| 6,257,050 | B1 | * | 7/2001 | Nagano et al. | 73/118.1 |
| 6,276,343 | B1 | * | 8/2001 | Kawamura et al. | 123/520 |

FOREIGN PATENT DOCUMENTS

| | | | | |
|---|---|---|---|---|
| EP | 0559854 B1 | | 9/1993 | |
| JP | 6502901 A | | 3/1994 | |
| JP | 6159157 A | | 6/1994 | |
| JP | 296509 | * | 11/1996 | F02M/25/08 |
| JP | 311153 | * | 11/1999 | F02M/25/08 |

* cited by examiner

*Primary Examiner*—Tony M. Argenbright
*Assistant Examiner*—Hai Huynh

(57) ABSTRACT

A fault diagnosing apparatus for evapopurge systems, including a device adapted to detect a pressure in the interior of an evapopassage including a fuel tank, a depressurization device adapted to close a first valve provided in an atmosphere-opened port of a canister and depressurize the interior of the evapopassage by a negative pressure occurring in a suction passage of an internal combustion engine, a repressurization device adapted to close a second valve after the operation of the depressurization device finishes, to repressurize the interior of the evapopassage, and a fault judgement device adapted to allow a judgement, which is based on an output from the pressure detecting device, that an evapopurge system is abnormal to be given on condition that the depressurization and repressurization devices are operated plural times.

15 Claims, 4 Drawing Sheets

FAULT DIAGNOSING APPARATUS FOR EVAPOPURGE SYSTEMS

BACKGROUND OF THE INVENTION

1. Field of the Invention

This invention relates to a fault diagnosing apparatus for evapopurge systems, adapted to adsorb a transpiration gas in a fuel tank to a canister, and purge the canister of the adsorbed fuel and discharge the resultant fuel into a suction passage of an internal combustion engine.

2. Description of the Related Art

An internal combustion engine is usually provided with an evapopurge system for preventing a transpiration gas occurring in a fuel tank from being discharged to the atmosphere. The evapopurge system is adapted to adsorb a transpiration gas occurring in the fuel tank to the canister via a vapor passage communicating the fuel tank and canister with each other, and purge the canister of the adsorbed fuel and discharge the resultant fuel into a suction passage of an internal combustion engine via a purge passage communicating the canister and suction passage with each other.

When the vapor passage and purge passage are damaged from a certain cause in an internal combustion engine provided with such an evapopurge system, the transpiration gas is discharged from the damaged portion into the atmosphere. In order to eliminate such an inconvenience, a fault diagnosing apparatus for detecting damage to the vapor passage and purge passage is provided.

Such fault diagnosing apparatuses for evapopurge systems include, for example, the apparatus disclosed in Japanese Patent Laid-Open No. 159157/1994 (U.S. Pat. No. 5,425,344). In the fault diagnosing apparatus for evapopurge systems disclosed in this publication, an evapopassage including a fuel tank is depressurized by a negative pressure of a suction passage, and thereafter closed and repressurized, whereby the damage (leakage of a transpiration gas) to the evapopassage is detected on the basis of pressure variation occurring during this time.

However, in such a fault diagnosing apparatus for evapopurge systems, the hopping (which will hereinafter be referred to as sloshing) of a fuel in the fuel tank occurs due to the operating condition of a vehicle, and, during this time, an amount of a transpiration gas occurring from the fuel increases. In such a case, there is the possibility that the evapopurge system be diagnosed erroneously as being out of order. Namely, when the sloshing of the fuel causes the amount of the transpiration gas occurring therefrom to increase, the pressure in the fuel tank increases in accordance with the increase in the amount of transpiration gas when the depressurized evapopassage is closed and repressurized. Consequently, the regained pressure in the evapopassage becomes high in a short period of time. This causes the fault diagnosing system for evapopurge systems to judge that the evapopassage is damaged in spite of the fact that the evapopassage is not actually damaged (the leakage of the transpiration gas does not occur), and diagnose the evapopassage as being out of order.

The related art fault diagnosing apparatus for evapopurge systems disclosed in the above-mentioned publication is adapted to detect the occurrence of the sloshing of a fuel in the fuel tank, and interrupt a fault judgement operation when the sloshing of the fuel occurs.

A fault diagnosing apparatus for evapopurge systems which has been made with a view to solving similar problems is disclosed in U.S. Pat. No. 5,398,661 (EP0559854), the apparatus being adapted to interrupt a fault judgement operation when the fuel tank is in a filled-up condition since, in such a condition, there is the possibility that even a very low level of transpiration of the fuel causes the regaining of pressure to be attained in a short period of time; and carry out a fault judgement operation with the engine in an idling condition and at a vehicle speed of not higher than a predetermined threshold value.

In these related art fault diagnosing apparatuses for evapopurge systems described above, a fault judgement operation is interrupted when the sloshing of a fuel occurs or when the fuel tank is in a filled-up condition, so that a fault of an evapopurge system is not erroneously diagnosed.

However, since the fuel tank is vibrated during the travel of a vehicle, the sloshing of a fuel more or less occurs. Consequently, in the apparatus of Japanese Patent Laid-Open No. 159157/1994, in which a fault judgement operation is interrupted when the sloshing of a fuel occurs, the opportunity of practicing a fault diagnosing operation for the evapopurge system is limited, so that a sufficient fault diagnosing operation cannot be carried out. In the apparatus of U.S. Pat. No. 5,398,661, in which a fault judgement operation is also carried out when the fuel tank is not in a filled-up condition with the engine and a vehicle speed in an idling condition and at a level not higher than a predetermined level respectively. Even in such an operating condition, the fault judgement operation receives influence of the occurrence of the sloshing of the fuel, and an erroneous judgement cannot be prevented.

SUMMARY OF THE INVENTION

The present invention has been made in view of the above-mentioned circumstances, and provides a fault diagnosing apparatus for evapopurge systems, capable of solving these problems, preventing the sloshing of a fuel from causing an erroneous judgement that an evapopurge system is out of order to be given, and reliably determining a fault of the evapopurge system no matter what the operating condition of the engine is.

According to an aspect of the present invention, the fault diagnosing apparatus for evapopurge systems includes a device for detecting a pressure in an evapopassage inclusive of a fuel tank, a depressurization device adapted to close a first valve, which is provided in an atmosphere-opened port of a canister, and depressurize the interior of the evapopassage by a negative pressure occurring in the interior of a suction passage, a repressurization device adapted to close a second valve, which is provided in a purge passage, after the depressurization device is operated, to repressurize the interior of the evapopassage, and a fault judgement device adapted to permit a judgement, which is based on an output from the pressure detecting device, that the evapopurge system is abnormal to be given on condition that the depressurization device and repressurization device are operated plural times.

When the depressurization and repressurization of the interior of the evapopassage are carried out plural times, the air in the evapopassage is discharged, and the evapopassage is filled with a transpiration gas, i.e., put in a saturated state, so that pressure variation ascribed to the sloshing of the fuel does not substantially occur. When a fault diagnosing operation for the evapopurge system is carried out in this condition on the basis of an output from the pressure detecting device, a fault can be determined accurately.

According to another aspect of the present invention, the fault diagnosing apparatus includes a device for detecting an amount of a fuel remaining in a fuel tank, and a device for setting the number of times of execution of operations of a depressurization device and a repressurization device on the basis of an output from the amount of remaining fuel detecting device. A generation rate of the transpiration gas differs with the amount of the fuel remaining in the fuel tank. Accordingly, when the number of times of execution of the operations of the depressurization and repressurization devices is set on the basis of the amount of the remaining fuel, a fault of the evapopurge system can be determined accurately.

In the fault diagnosing apparatus for evapopurge systems, in which the number of times of execution of operations of depressurization and repressurization devices is set on the basis of an amount of a remaining fuel, the increasing of the number of times of execution of the depressurization and repressurization of the interior of an evapopassage in accordance with a decrease in the amount of the remaining fuel enables a fault to be determined more accurately.

Operating the fault judgement device when the amount of the remaining fuel determined by the amount of remaining fuel detecting device is larger than 40% of the capacity of the fuel tank reduces the fault diagnosis continuation time, and is therefore preferable. It is also preferable to provide a fuel temperature detecting device, and change the number, which is set by the number of operation setting device, of the execution of depressurization and repressurization operations on the basis of an output from the fuel temperature detecting device. This enables the numbers of the execution of the depressurization and repressurization operations to be set properly, and the fault diagnosis continuation time to be reduced.

According to still another aspect of the present invention, the fault diagnosing apparatus includes a device for detecting an amount of a fuel remaining in a fuel tank, and a fault judgement device, the fault judgement device including a member for setting reference number of times of execution of operations of depressurization and repressurization devices on the basis of an output from the amount of remaining fuel detecting device, and a reference value setting member for setting a reference repressurization value on the basis of an output from the amount of remaining fuel detecting device, the fault judgement device being preferably adapted to judge that an evapopurge system is normal when the number of times of execution of the operations of the depressurization and repressurization devices is not smaller than one and not larger than the reference number set by the number of times of operations setting member with a regained pressure in an evapopassage detected by a pressure detecting device becoming not higher than a reference regained pressure value set by the reference value setting member; and judge that the evapopurge system is abnormal when the number of times of execution of the operations of the depressurization and repressurization devices exceeds the reference number of times set by the number of times of operations setting member with regained pressure in the evapopassage detected by the pressure detecting device every time the depressurization and repressurization operations are executed exceeding a reference regained pressure value set by the reference value setting member. Since the normality of the evapopurge system can be determined speedily, and since the determination of the abnormality thereof can be done accurately, the reduction of total fault diagnosis continuation time can be attained.

BRIEF DESCRIPTION OF THE DRAWINGS

A preferred embodiment of the present invention will be described in detail on the basis of the following figures, wherein.

DESCRIPTION OF THE PREFERRED EMBODIMENT

A mode of embodiment of the present invention will now be described in detail with reference to FIGS. 1–5.

Figure 1:
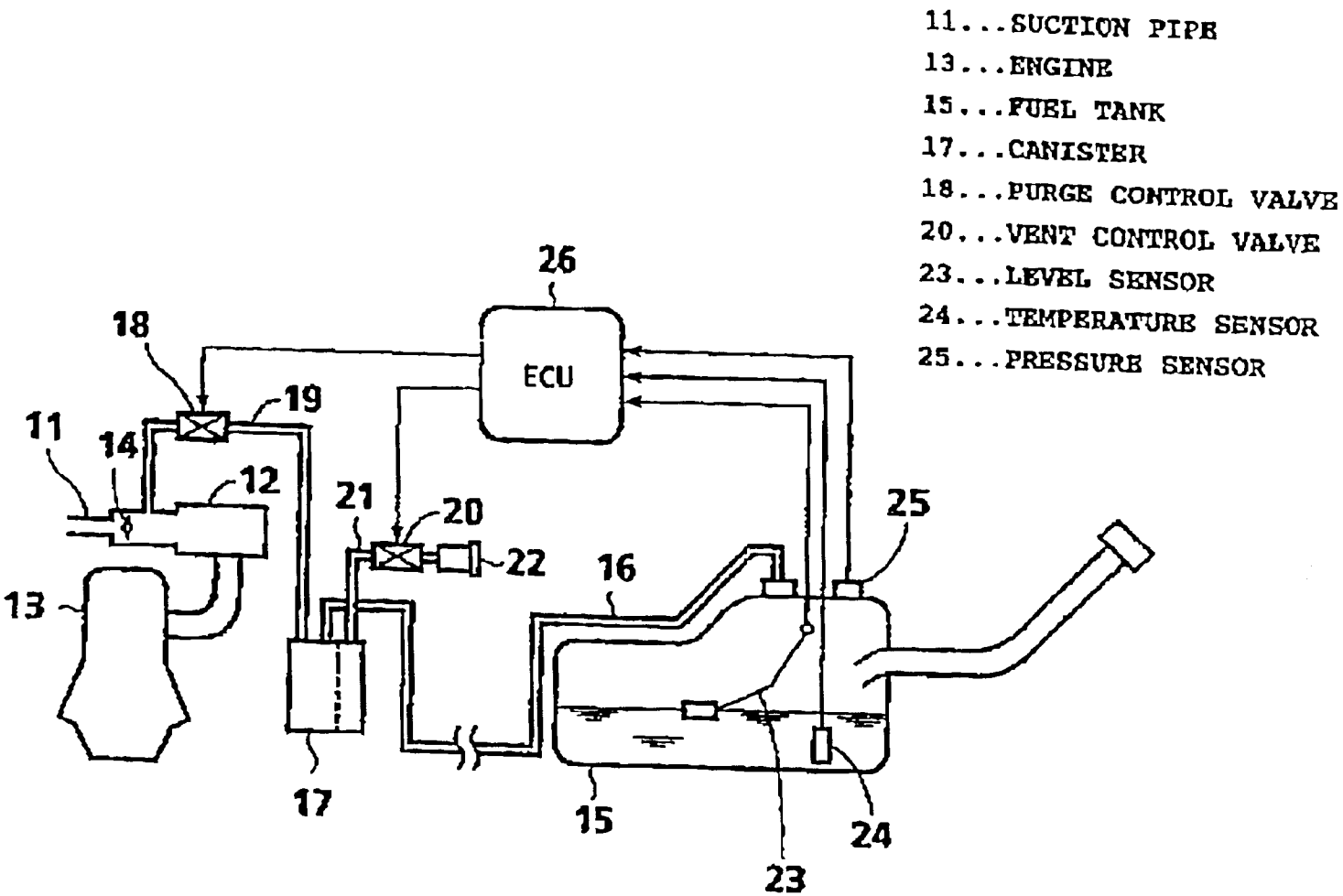
FIG. 1 is a schematic construction diagram of a mode of embodiment of the fault diagnosing apparatus for evapopurge systems according to the present invention.

In an evapopurge system, an air cleaner (not shown) is connected to a suction port of an engine 13 via a suction pipe 11 and a surge tank 12 as shown in FIG. 1. The suction pipe 11 is provided with a throttle valve 14. A canister 17 is connected to a fuel tank 15 via a discharge pipe (vapor passage) 16. The canister 17 is also connected to the suction pipe 11 via a supply pipe (purge passage) 19 having a purge control valve (second valve) 18, while a discharge pipe 21 having a vent control valve (first valve) 20 is connected to the canister 17. A filter 22 is fixed to a free end portion of this discharge pipe 21. The canister 17 temporarily stores a transpiration gas (noxious substances, such as HC) occurring in the fuel tank 15, and has the transpiration gas sucked into the suction pipe 11 by a negative pressure during an operation (at the starting) of the engine 13. Therefore, the fuel tank 15, discharge pipe 16, canister 17, supply pipe 19 and discharge pipe 21 form an evapopassage.

The fuel tank 15 is provided with a level sensor 23 as a device for detecting an amount of a remaining fuel, a temperature sensor 24 as a device for detecting a temperature of the fuel, and a pressure sensor 25 as a device for detecting a pressure in the interior of the evapopassage. These sensors 23, 24, 25 are connected to an electronic control unit (which will hereinafter be referred to as ECU) 26, and the results of detection are outputted therefrom. The ECU 26 is capable of controlling the opening and closing of the purge control valve 18 and vent control valve 20 in accordance with the operating condition of the engine 13.

In this mode of embodiment of the fault diagnosing apparatus for evapopurge systems, the vent control valve 20 is closed to depressurize (depressurization device) the interior of the evapopassage by a negative pressure occurring in the interior of the suction pipe 11, and the purge control valve 18 is thereafter closed with the vent control valve 20 kept closed, to repressurize (repressurization device) the interior of the evapopassage, damage (leakage of a transpiration gas) to the evapopassage being detected (fault judgement device) on the basis of variation of a pressure therein. In this mode of embodiment of the fault diagnosing apparatus for evapopurge systems, the making of a fault diagnosis (judgement of the abnormality of an evapopurge system) is allowed on condition that the depressurization and repressurization operations are carried out plural times.

A fault diagnosing method carried out by this fault diagnosing apparatus for evapopurge systems will now be described with reference to a flow chart of FIG. 2 and a time chart of FIG. 3.

Figure 2:
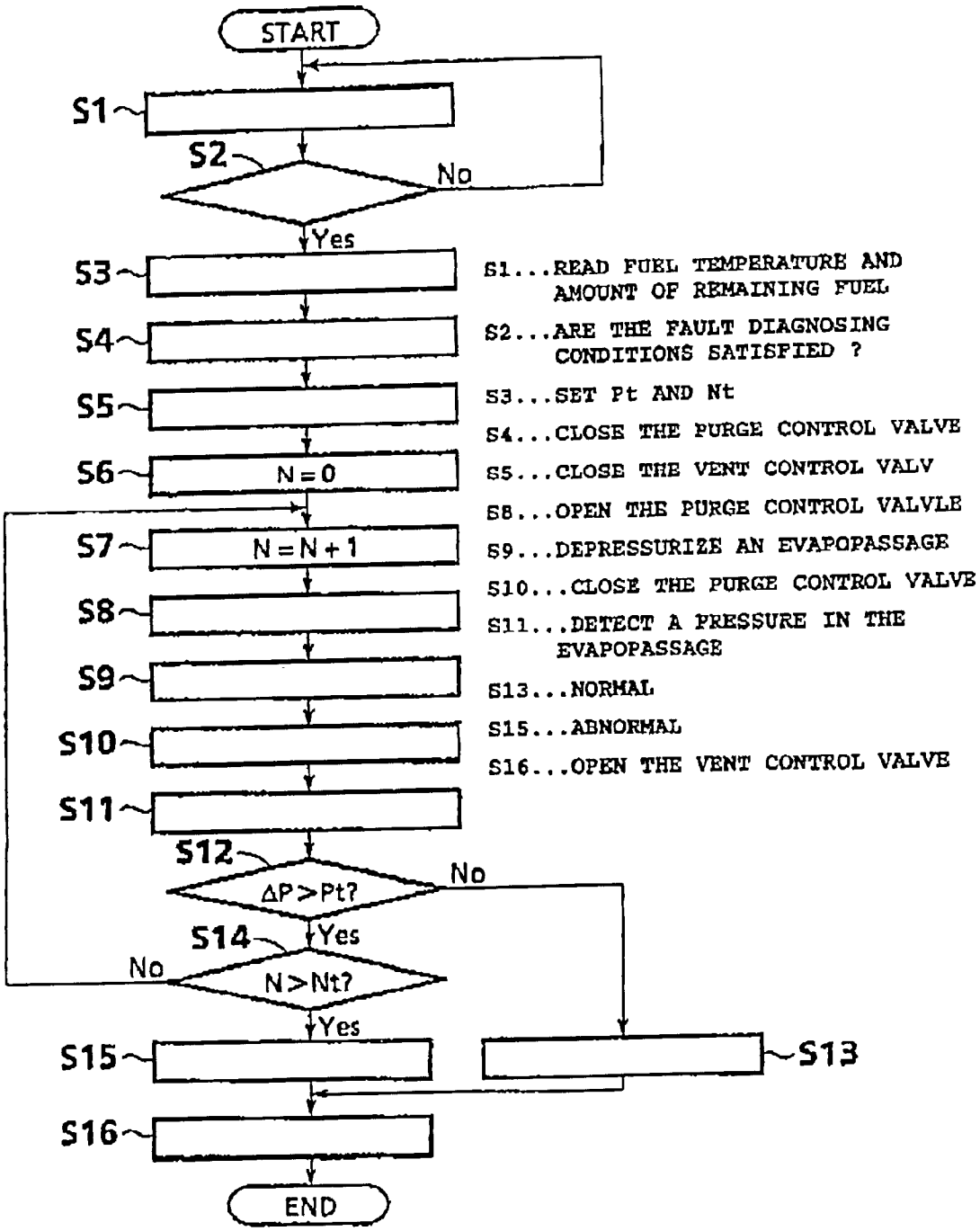
FIG. 2 is a flow chart of an operation of the fault diagnosing apparatus for evapopurge systems.

As shown in FIG. 2, an amount of remaining fuel detected by the level sensor 23 and a fuel temperature detected by the temperature sensor 24 are read in a step S1. In a step S2, the fault diagnosing conditions are judged as to whether they are satisfied with a permitted operational condition, i.e., a fuel temperature and an amount of the remaining fuel are judged as to whether they are not at an extremely high level, and not higher than a predetermined level, for example, 40% respectively. When the fuel temperature is not at an extremely high level with the amount of the remaining fuel over 40%, a fault diagnosing process is started.

Figure 4:
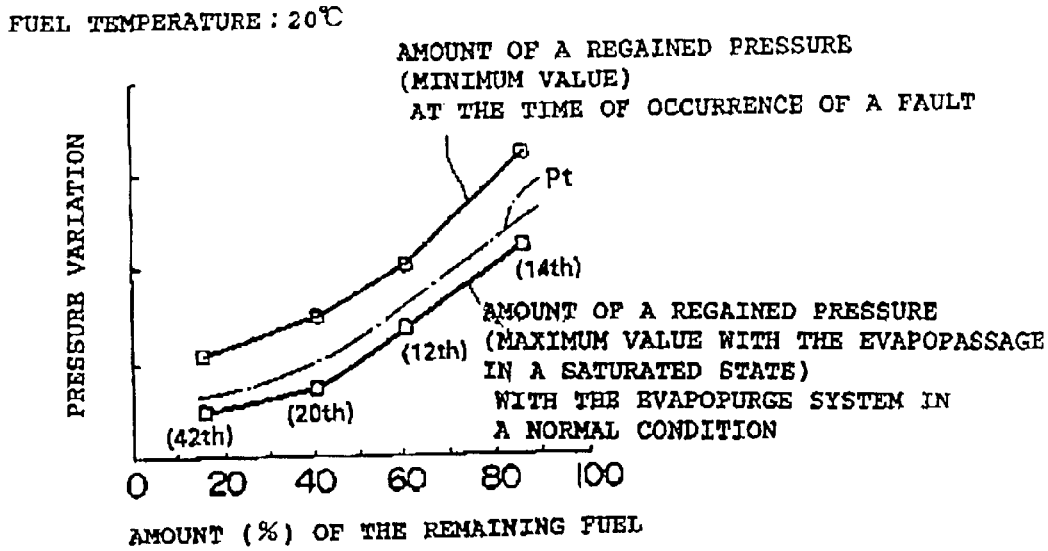
FIG. 4 is a graph showing pressure variation and the number of times of execution of depressurization and repressurization operations with respect to an amount of a remaining fuel.
Figure 5:
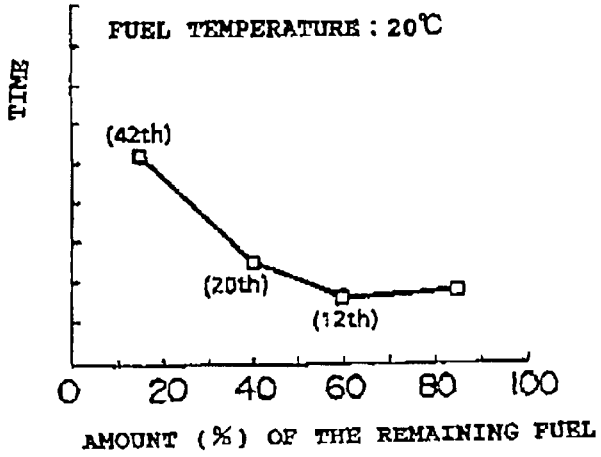
FIG. 5 is a graph showing the processing time and the number of times of execution of the above-mentioned operations with respect to the amount of the remaining fuel.

In a step S3, a reference regained pressure value Pt and a reference number of times (reference number of times of operations) of execution Nt of depressurization and repressurization operations in the interior of the evapopassage are set. This reference regained pressure value Pt is set (reference value setting device) on the basis of a map set in advance by experiment, for example, a map of FIG. 4 showing variation of pressure (repressurization) with respect to the amount of the remaining fuel. The parenthesized numerals in the graph of FIG. 4 show that the pressure in the interior of the evapopassage does not vary greatly due to the transpiration of the fuel in the fuel tank 15, i.e., it shows the number of times of execution of operations at which a substantial saturated condition can be attained. The reference number of times Nt is also set (number of times of operation setting device) on the basis of a map set in advance by experiment, for example, a map of FIG. 5 showing the number of times of execution of operations (processing time) with respect to the amount of the remaining fuel.

Thus, the reference regained pressure value Pt and reference number of times of execution Nt of operations are changed in accordance with the amount of the remaining fuel, and also in accordance with the fuel temperature.

Figure 3:
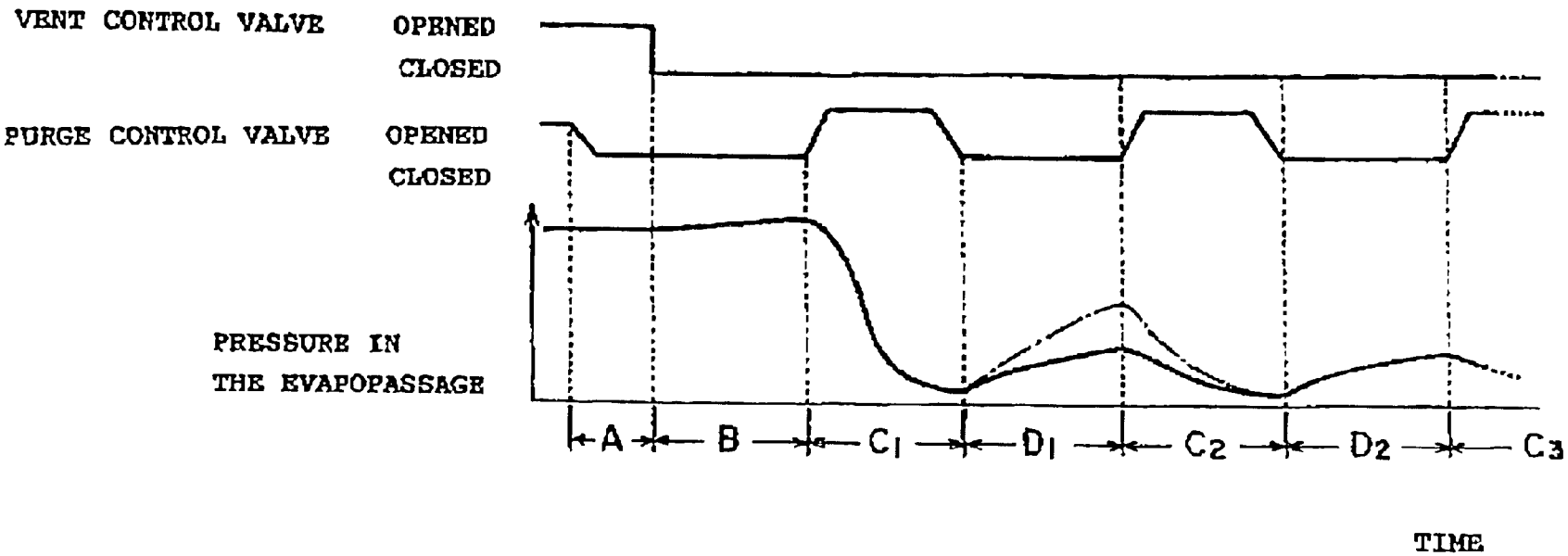
FIG. 3 is a time chart showing the operation of the fault diagnosing apparatus for evapopurge systems.

In a step S4, the purge control valve 18 is closed, and, in a step S5, the vent control valve 20 is closed, whereby the interior of the evapopassage is changed from an atmospheric condition into a tightly closed condition (zones A–B in FIG. 3). Then, in a step S6, the number of times of execution N of operations is reset, and one is thereafter added to the number of times of execution N of operations in a step S7, i.e., N is set to N=1, the purge control valve 18 being opened in a step S8. Consequently, the evapopassage (supply pipe 19) is communicated with the suction pipe 11 in a step S9 to cause the evapopassage to be depressurized (zone C1 in FIG. 3) due to a negative pressure occurring in the suction pipe 11. When the purge control valve 18 is closed in a step S10, the interior of the evapopassage is put in a tightly closed state again, and gradually repressurized (zone D1 in FIG. 3) due to the occurrence of a transpiration gas, or due to the leakage of the same gas when there is damage to an inner portion of the evapopassage. In a step S11, the pressure in the evapopassage is detected by the pressure sensor 25 after the purge control valve is closed, and after a predetermined period of time elapses, respectively. In a step S12, a regained pressure ΔP representative of pressure variation in the evapopassage occurring after the lapse of a predetermined period of time and the reference regained pressure value Pt are compared with each other.

When there is not damage (atmosphere-opened portion) to the inner portion of the evapopassage, the actual regained pressure ΔP is not higher than the reference regained pressure value Pt (solid line shown in a zone D1 of FIG. 3) but, when there is damage to the inner portion of the evapopassage, the actual regained pressure ΔP becomes higher (one-dot chain line shown in the zone D1 of FIG. 3) owing to the inflow of the air than the reference regained pressure value Pt, whereby the pressure in the evapopassage returns gradually to an atmospheric pressure.

Therefore, when the regained pressure ΔP is not higher than the reference regained pressure value Pt in the step S12, a judgement that the evapopassage is free from damage and normal is given in a step S13, and the vent control valve 20 is opened in a step S16 to finish the fault diagnosing process.

When the regained pressure ΔP is higher than the reference regained pressure value Pt in the step S12, it indicates that there is damage to the evapopassage, or that the sloshing of the fuel occurs. Namely, when the answer to the question in the step S12 is affirmative, a judgement as to whether the number of times of execution N of the depressurization and repressurization operations in the evaporation passage is larger than the reference number of times of execution Nt of the same operations or not is given in the step S14. Namely, the step S14 is a method of ascertaining that an increase in the regained pressure ΔP is caused by damage to the evapopassage or the sloshing of the fuel. When the depressurization and repressurization operations in the evapopassage are executed plural times, it can be rendered possible to prevent variation from occurring in the amount of regained pressure even through the sloshing of the fuel occurs.

When the depressurization and repressurization operations are thus carried out plural times in the evapopassage, the air therein is discharged, and a saturated condition in which the evapopassage is filled with a transpiration gas is formed, and pressure variation due to the sloshing of the fuel does not substantially occur. When the regained pressure ΔP increases even in this condition, a judgement that there is damage to the evapopassage can be given.

Therefore, when a judgement that the regained pressure ΔP is not higher than the reference regained pressure value Pt is not given in the step S12, the operation is returned from the step S14 to the step S7 to repeat the process of the steps S7–S14 (except S13) until the number of times of execution N of depressurization and repressurization operations exceeds the reference number of times of execution Nt of the same operations. The reference number of times of execution Nt of these operations is set on the basis of the fuel temperature and the amount of the remaining fuel.

When the process of the steps S7–S14 is thus repeated with damage to the evapopassage not existing, the interior of the evapopassage is saturated with a transpiration gas, so that the regained pressure ΔP due to the transpiration gas is held down. Consequently, the regained pressure ΔP becomes not higher than the reference regained pressure value Pt in the step S12, and the operation advances to the step S13, in which a judgement that the evapopassage is free from damage and normal is given.

When there is damage to the evapopassage, the regained pressure ΔP exceeds the reference regained pressure Pt due to the inflow of the air from the damaged portion (atmosphere-opened portion) even though the process of the steps S7–S14 is repeated, so that the number of times of execution N of the depressurization and repressurization operations exceeds the reference number of times of execution Nt of the same operations.

Accordingly, in the step S14, giving a judgement that the evapopurge system is abnormal is allowed on condition that the number of times of execution N of the depressurization and repressurization operations exceeds the reference number of times of execution Nt. In a step S15, a judgement that the evapopurge system is abnormal due to the existence of damage to the evapopassage is given, and an alarm lamp is lit or an alarm sound is made against the driver. In a step S16, the vent control valve 20 is opened to finish the fault diagnosing process.

Thus, in this mode of embodiment of the fault diagnosing apparatus for evaposystems, depressurization and repressurization operations are executed plural times in the evapopassage to put the interior of the evapopassage in a transpiration gas-filled saturated state in which pressure variation ascribed to the sloshing of a fuel does not substantially occur, and the magnitude of the regained pressure $\Delta P$ is then determined, whereby the damage (leakage of the transpiration gas) to the evapopassage can be detected properly.

In this mode of embodiment, a judgement that the evapopurge system has a fault is allowed to be given in the step S2 on condition that the amount of the remaining fuel is not smaller than 40% but the amount of the remaining fuel is not limited to this numerical value. When the reduction of the diagnosis processing time is desired, the amount of the remaining fuel, which constitutes the conditions for allowing a judgement that the evapopurge system has a fault to be given, may be set, for example, larger than 40%. Although the reference number of times of execution Nt of depressurization and repressurization operations in this embodiment is set on the basis of the amount of the remaining fuel and fuel temperature, it may be set on the basis of only the amount of the remaining fuel so as to simplify the maps to be used.

What is claimed:

1. A fault diagnosing apparatus for evapopurge systems, adapted to have a transpiration gas occurring in a fuel tank adsorbed to a canister via a vapor passage communicating the fuel tank and canister with each other, and purge the canister of the fuel adsorbed thereto and discharge the resultant fuel into a suction passage of an internal combustion engine via a purge passage communicating the canister and suction passage with each other, comprising:

a device adapted to detect a pressure in the interior of an evapopassage including the fuel tank, a depressurization device adapted to close a first valve provided in an atmosphere-opened port of the canister and depressurize the interior of the evapopassage by a negative pressure occurring in the suction passage, a repressurization device adapted to close a second valve, which is provided in the purge passage, after the operation of the depressurization device finishes, to repressurize the interior of the evapopassage, and a fault judgement device adapted to allow a judgement, which is based on an output from the pressure detecting device, that an evapopurge system is abnormal to be given on condition that the depressurization and repressurization devices are operated plural times.

2. A fault diagnosing apparatus for evapopurge systems according to claim 1, wherein the apparatus further includes a device for detecting an amount of remaining fuel in the fuel tank, the fault judgement device having a member for setting a reference number of times of operations of the depressurization and repressurization devices on the basis of an output from the mount of remaining fuel detecting device.

3. A fault diagnosing apparatus for evapopurge systems according to claim 2, wherein the number of times of operations setting member is adapted to set larger the reference number of times of operations of the depressurization and repressurization devices in accordance with a decrease in the amount of the remaining fuel detected by the amount of remaining fuel detecting device.

4. A fault diagnosing apparatus for evapopurge systems according to claim 2, wherein the fault judgement device is adapted to allow a judgement that the evapopurge system is abnormal to be given when the amount of the remaining fuel detected by the amount of remaining fuel detecting device exceeds 40% of a capacity of the fuel tank.

5. A fault diagnosing apparatus for evapopurge systems according to claim 2, wherein the apparatus further includes a device for detecting a temperature of the fuel in the fuel tank, the number of times of operation setting member being adapted to set a reference number of times of operations of the depressurization and repressurization devices on the basis of the amount of the remaining fuel detected by the amount of remaining fuel detecting device and the fuel temperature detected by the fuel temperature detecting device.

6. A fault diagnosing apparatus for evapopurge systems according to claim 1, wherein the apparatus further includes a device for detecting an amount of remaining fuel in the fuel tank, the fault judgement device having a number of times of operations setting member for setting a reference number of times of operations of the depressurization and repressurization devices on the basis of an output from the amount of remaining fuel detecting device, and a reference value setting member for setting a reference regained pressure value on the basis of an output from the amount of remaining fuel detecting device.

7. A fault diagnosing apparatus for evapopurge systems according to claim 6, wherein the fault judgement device is adapted to judge that the evapopurge system is normal when the number of times of execution of the operations of the depressurization and repressurization devices is not smaller than one and not larger than the reference number set by the number of times of operations setting member with a regained pressure in the evapopassage detected by the pressure detecting device becoming not higher than a reference regained pressure value set by the reference value setting member; and judge that the evapopurge system is abnormal when the number of times of execution of the operations of the depressurization and repressurization devices exceeds the reference number of times set by the number of times of operations setting member with the regained pressure in the evapopassage detected by the pressure detecting device every time the depressurization and repressurization operations are executed exceeding a reference regained pressure value set by the reference value setting member.

8. A method for diagnosing faults of an evapopurge system in which a transpiration gas occurring in a fuel tank is absorbed in a canister via a vapor passage and the canister is purged by discharging absorbed fuel into a suction passage of an internal combustion engine via a purge passage, said method comprising:

detecting a pressure in an interior of an evapopassage including the fuel tank;

depressurizing the interior of the evapopassage, after closing a first valve provided in an atmosphere-opened port of the canister, by a negative pressure occurring in the suction passage of the internal combustion;

repressurizing the interior of the evapopassage, after the operation of depressurizing has completed, by closing a second valve provided in the purge passage; and determining a fault of the evapopurge system based on output from the detecting step on condition that the steps of depressurizing and repressurizing are performed plural times.

9. The method according to claim 8, further comprising:

detecting an amount of fuel remaining in the fuel tank; and setting a reference number of times of depressurizing and repressurizing based on the amount of remaining fuel detected.

10. The method according to claim 9, wherein the setting step increases said reference number in accordance with a decrease in the amount of the remaining fuel detected.

11. The method according to claim 9, wherein the determining step determines that the evapopurge system is faulty only if the amount of remaining fuel exceeds 40% of a capacity of the fuel tank.

12. The method according to claim 9, further comprising:

detecting a temperature of the fuel in the fuel tank, said setting step setting the reference number based on the amount of remaining fuel and the fuel temperature.

13. The method according to claim 9, further comprising:

setting a reference regained pressure value based on the amount of remaining fuel.

14. The method according to claim 13, wherein the step of determining a fault does not indicate that the evapopurge system is faulty when the number of times the depressurizing step and the repressurizing step have been executed is not larger than the reference number, even when a measure of regained pressure in the evapopassage becomes higher than the reference regained pressure value.

15. The method according to claim 13, wherein the step of determining a fault determines that the evapopurge system is faulty when the number of times the depressurizing step and the repressurizing step have been performed exceeds the reference number and a measure of regained pressure in the evapopassage each time the depressurizing step and the repressurizing step are executed exceeds the reference regained pressure value.

* * * * *